US008056839B2

(12) United States Patent
Uratani et al.

(10) Patent No.: US 8,056,839 B2
(45) Date of Patent: Nov. 15, 2011

(54) ELECTROSTATIC ATOMIZER

(75) Inventors: Yutaka Uratani, Kadoma (JP); Kenji Obata, Kadoma (JP); Atsushi Isaka, Kadoma (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 219 days.

(21) Appl. No.: 12/292,714

(22) Filed: Nov. 25, 2008

(65) Prior Publication Data

US 2009/0134249 A1 May 28, 2009

(30) Foreign Application Priority Data

Nov. 27, 2007 (JP) ..... 2007-306595

(51) Int. Cl.
*B05B 5/00* (2006.01)
*F23D 11/32* (2006.01)

(52) U.S. Cl. ..... 239/691; 239/690; 239/690.1

(58) Field of Classification Search ..... 239/690, 239/691, 690.1
See application file for complete search history.

(56) References Cited

U.S. PATENT DOCUMENTS 5,240,186 A * 8/1993 Dobbins et al. ..... 239/690.1
5,972,417 A * 10/1999 Perkins et al. ..... 427/8
6,206,307 B1 * 3/2001 Kelly et al. ..... 239/690
7,494,532 B2 * 2/2009 Azukizawa et al. ..... 96/27
2005/0040262 A1 * 2/2005 Nagai ..... 239/690
2007/0101934 A1 5/2007 Nishio et al.
2008/0130189 A1 6/2008 Kobayashi et al.
2009/0206185 A1 8/2009 Akisada et al.

FOREIGN PATENT DOCUMENTS

| | | |
|---|---|---|
| EP | 1 733 798 | 12/2006 |
| EP | 1 908 527 | 4/2008 |
| JP | 2006-061833 | 3/2006 |
| JP | 2006-122759 | 5/2006 |
| JP | 2007-021370 | 2/2007 |

OTHER PUBLICATIONS

European Office action dated Oct. 20, 2010 for corresponding European application No. 08020559.4-2425.

* cited by examiner

*Primary Examiner* — Dinh Nguyen
(74) *Attorney, Agent, or Firm* — Bacon & Thomas, PLLC

(57) ABSTRACT

An electrostatic atomizer includes an atomizing electrode, a water supply unit for supplying water to the atomizing electrode, a high voltage power circuit and a control unit. The high voltage power circuit applies a high voltage to the atomizing electrode to electrostatically atomizing water supplied to the atomizing electrode and to generate electrically charged water particles. The control unit controls the high voltage power circuit such that the voltage applied to the atomizing electrode is gradually increased at the time of starting the electrostatic atomizer. Further, the control unit may control the high voltage power circuit such that the voltage is increased to a target voltage in steps at the time of starting the electrostatic atomizer, and an increment of the voltage at each step is decreased as the voltage approaches the target voltage.

11 Claims, 7 Drawing Sheets

ELECTROSTATIC ATOMIZER

FIELD OF THE INVENTION

The present invention relates to a technology for generating electrically charged water particles by using an electrostatic atomization phenomenon.

BACKGROUND OF THE INVENTION

Conventionally, there is known an electrostatic atomizer for generating electrically charged water particles by cooling an atomizing electrode to allow moisture in air to be condensed on the atomizing electrode, applying high voltage to the condensate water on the atomizing electrode by a high voltage power circuit and thus electrostatically atomizing the condensate water.

In the electrostatic atomizer, when a starting voltage is applied to the atomizing electrode of the electrostatic atomizer, Coulomb's force acts on the water on the tip portion of the atomizing electrode, so that the level of the water locally swells in the shape of a needle having a pointed leading end (called a "Taylor cone"). Electric charges are concentrated on the leading end of the Taylor cone, and thus become densified, so that electric field intensity and Coulomb's force thereabout are increased and the Taylor cone grows. The water around the leading end of Taylor cone receives great energy (repulsive force of the densified charges) and is repeatedly segmented and scattered (called Rayleigh scattering), thereby generating charged water particles of nanometer size.

However, when a voltage is applied to the atomizing electrode from the high voltage power circuit at the time of starting the electrostatic atomizer, rush current flows, so that idle discharge (minus ion discharge) occurs in a state in which the Taylor cone is not formed. To that end, the tip portion of the atomizing electrode is vaporized, worn and deteriorated due to long periodic use, thereby resulting in unstable electrostatic atomization.

Further, it is disclosed in, e.g., Japanese Patent Laid-open Publication No. 2007-21370 that, in the electrostatic atomizer, the output of a discharge voltage is fed back to the high voltage power circuit, thus decreasing the variation in high voltage. However, Japanese Patent Laid-open Publication No. 2007-21370 does not disclose a technology of preventing the deterioration of the atomizing electrode due to the idle discharge at the time of starting the electrostatic atomizer.

SUMMARY OF THE INVENTION

The present invention provides an electrostatic atomizer capable of stably performing electrostatic atomization for a long period of time by preventing the deterioration of an atomizing electrode due to an idle discharge at the time of starting the electrostatic atomizer.

In accordance with an aspect of the present invention, there is provided an electrostatic atomizer, including: an atomizing electrode; a water supply unit for supplying water to the atomizing electrode; and a high voltage power circuit for applying a high voltage to the atomizing electrode to electrostatically atomize water supplied to the atomizing electrode and to generate electrically charged water particles; and a control unit for controlling the high voltage power circuit such that the voltage applied to the atomizing electrode is gradually increased at the time of starting the electrostatic atomizer.

With such configuration, rush current can be prevented from flowing at the time of starting the electrostatic atomizer, and the deterioration of the atomizing electrode attributable to the evaporation and wear thereof by idle discharge at the time of starting the electrostatic atomizer can be prevented.

Preferably, the control unit controls the high voltage power circuit such that the voltage is increased to a target voltage in steps at the time of starting the electrostatic atomizer, and an increment of the voltage at each step is decreased as the voltage approaches the target voltage.

In this way, it is possible to further ensure that no rush current flows at the time of starting the electrostatic atomizer.

The electrostatic atomizer may further include an abnormal voltage detection unit for detecting an abnormality in the voltage of the high voltage power circuit. When the voltage exceeds an upper and a lower limit of a controllable range of the voltage for continuously operating the electrostatic atomizer by the control unit, the abnormal voltage detection unit detects the abnormality of the voltage.

Further, the electrostatic atomizer may further include a protection circuit provided to the high voltage power circuit. The protection circuit serves to decrease the voltage when a discharge current output in the high voltage power circuit is increased beyond a predetermined value.

In accordance with the present invention, rush current can be prevented from flowing at the time of starting the electrostatic atomizer, and the deterioration of the atomizing electrode attributable to the evaporation and wear thereof by idle discharge at the time of starting the electrostatic atomizer can be prevented. Accordingly, the electrostatic atomization can be stably performed for an extended period of time.

BRIEF DESCRIPTION OF THE DRAWINGS

The objects and features of the present invention will become apparent from the following description of embodiments, given in conjunction with the accompanying drawings, in which.

DETAILED DESCRIPTION OF THE EMBODIMENTS

Hereinafter, embodiments of the present invention will be described in detail with reference to the accompanying drawings.

An electrostatic atomizer 4 includes an atomizing electrode 1, water supply unit 2 for supplying water to the atomizing electrode 1, and a high voltage power circuit 3 for applying a high voltage to the water supplied to the atomizing electrode 1.

In the embodiment of the present invention, for example, the water supply unit 2 supplies water to the atomizing electrode 1 by means of a cooling unit for allowing the moisture in air to be condensed.

Figure 9:
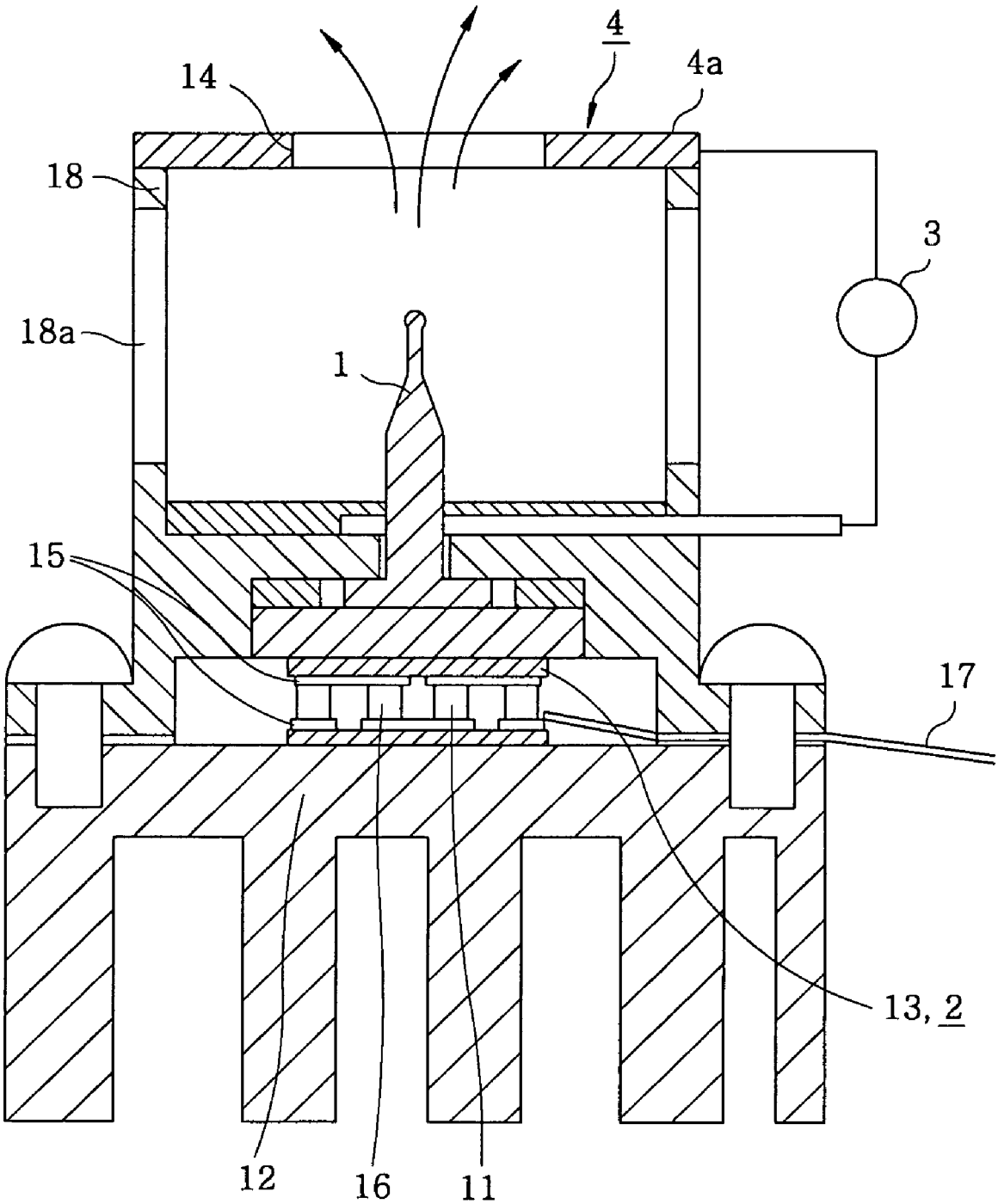
FIG. 9 is a schematic view showing an electrostatic atomizer in accordance with the present invention.

FIG. 9 is a schematic view showing an atomization block 4*a* of the electrostatic atomizer 4 in accordance with the embodiment of the present invention. In the embodiment shown in FIG. 9, the cooling unit is configured as a Peltier unit 11, and the moisture in air is cooled by the cooling unit to be condensed, so that the water is supplied to the atomizing electrode 1.

The Peltier unit 11 includes a pair of Peltier circuit boards 15 each of which has an insulation plate made of alumina or aluminum nitride having high thermal conductivity, the insulation plate having a circuit pattern on one side thereof. The Peltier circuit boards 15 are disposed opposite to each other such that their circuit patterns face to each other. Bi—Te based thermoelectric elements 16 are arranged in rows between the Peltier circuit boards 15 and the adjacent thermoelectric elements 16 are electrically connected with each other through the circuit boards 15. Thus, heat is transferred from one of the Peltier circuit boards 15 to the other Peltier circuit board 15 by applying electricity from a Peltier power source 30 to the thermoelectric elements 16 through a Peltier input lead line 17. Further, a cooling section 13 is connected to one of the Peltier circuit boards 15, and a heat radiating section 12 is connected to the other Peltier circuit board 15. In the embodiment of the present invention, a heat radiating fin is employed as an example of the heat radiating section 12. The cooling section 13 of the Peltier unit 11 is connected to the rear end of the atomizing electrode 1.

The atomizing electrode 1 is surrounded by a housing 18 made of an insulation material, and the housing 18 is provided in the peripheral wall thereof with windows 18*a* through which the inside and the outside of the housing 18 communicate with each other. Further, a ring-shaped counter electrode 14 is disposed in the front opening of the housing 18 opposite to the atomizing electrode 1 such that the center of the ring-shaped counter electrode 14 is located on an extension line of the central axis of the atomizing electrode 1.

In the electrostatic atomizer 4, the cooling section 13 is cooled by applying current to the Peltier unit 11, so that the atomizing electrode 1 is cooled by the cooled cooling section 13. Accordingly, the moisture in air is condensed, thereby supplying water (condensate water) to the atomizing electrode.

When a high voltage is applied between the atomizing electrode 1 and the counter electrode 14 in a state in which the water (condensate water) is supplied to the atomizing electrode 1 as described above, Coulomb's force is applied between the water supplied to the tip portion of the atomizing electrode 1 and the counter electrode 14 by the high voltage applied between the atomizing electrode 1 and the counter electrode 14. Thus, the level of the water locally swells in the shape of a needle having a pointed leading end (called a "Taylor cone"). Electric charges are concentrated on the leading end of the Taylor cone, and thus become densified, so that electric field intensity and Coulomb's force therearound are increased and the Taylor cone grows. The water around the leading end of Taylor cone receives great energy (repulsive force of the densified charges) and is repeatedly segmented and scattered (called Rayleigh scattering), thereby generating minus-charged water particles of nanometer size. The charged water particles thus generated are discharged to the outside in the direction of arrows shown in FIG. 9.

Figure 3:
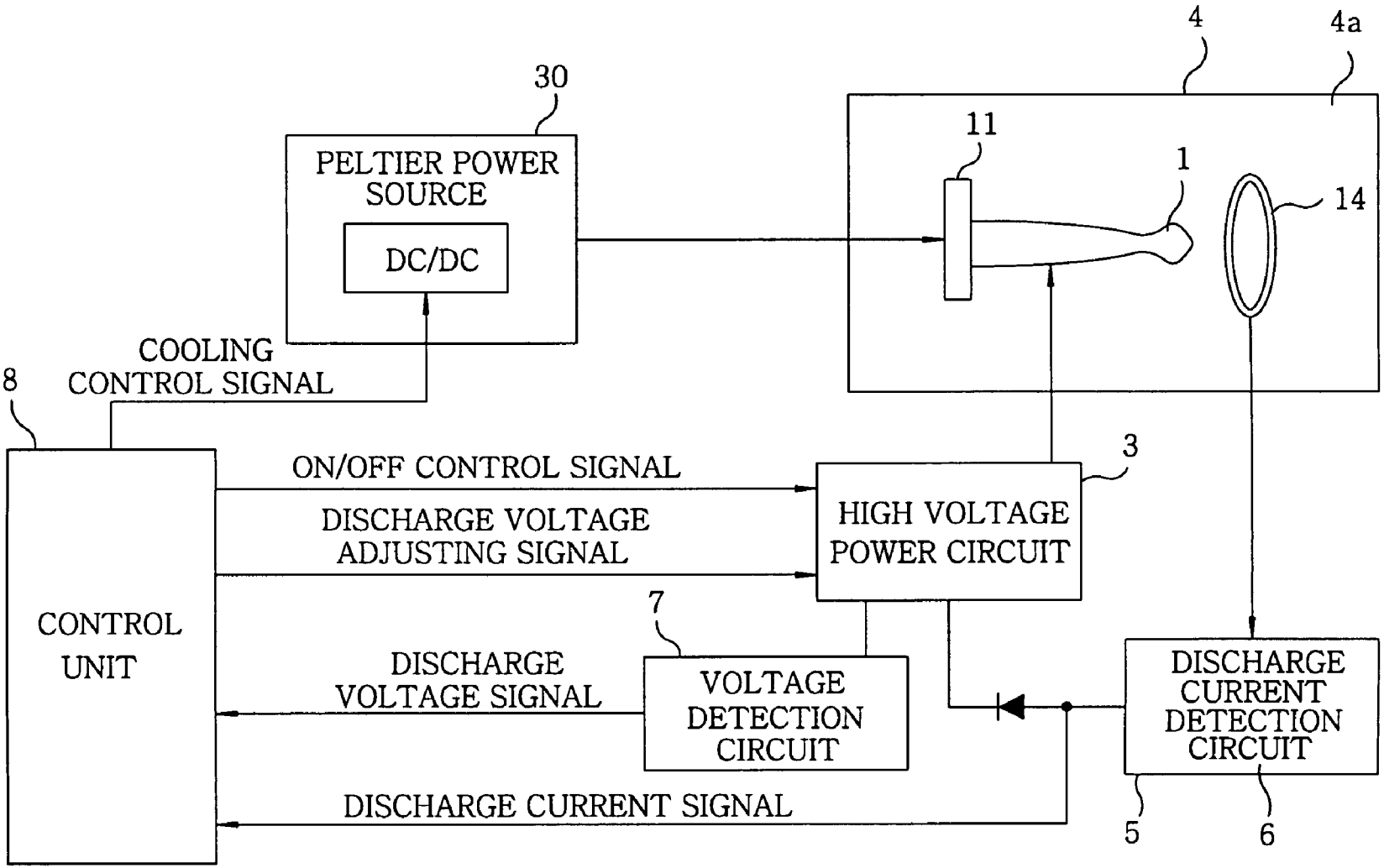
FIG. 3 is a control block diagram in accordance with an embodiment of the present invention.

FIG. 3 shows a control block diagram of the electrostatic atomizer 4 in accordance with the present embodiment.

In FIG. 3, reference numeral 8 indicates a control unit including a microcomputer, reference numeral 6 indicates a discharge current detection circuit, reference numeral 7 indicates a voltage detection circuit, reference numeral 3 indicates a high voltage power circuit, reference numeral 4*a* indicates an atomization block, and reference numeral 30 indicates a Peltier power source.

Figure 1:
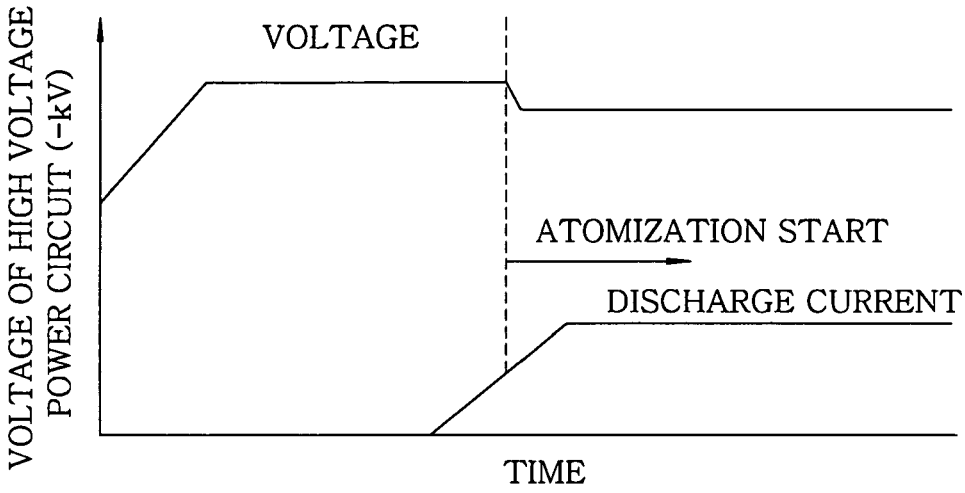
FIG. 1 is a graph showing a time chart of a voltage applied from a high voltage power circuit to an atomizing electrode in accordance with an embodiment of the present invention.

Here, in the present embodiment, when a high voltage is applied to the atomizing electrode (discharge electrode) 1 by the high voltage power circuit at the time of starting the electrostatic atomizer 4, the control unit 8 controls the high voltage power circuit such that a target high voltage is obtained by gradually increasing the applied voltage as shown in FIG. 1. Accordingly, it is possible to prevent rush current from flowing at the time of starting the electrostatic atomizer, so that the deterioration of the atomizing electrode attributable to the evaporation and wear thereof by idle discharge at the time of starting the electrostatic atomizer can be prevented.

Figure 2:
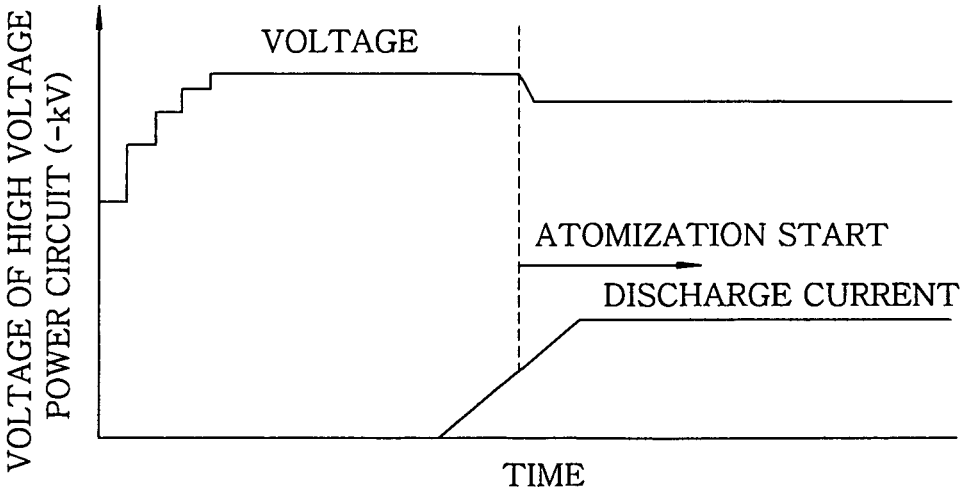
FIG. 2 is a graph showing a time chart of a voltage applied from a high voltage power circuit to an atomizing electrode in accordance with another embodiment of the present invention.

Further, in another embodiment shown in FIG. 2, when the control unit 8 controls the high voltage power circuit such that a target voltage is obtained by gradually increasing the applied voltage, the control unit 8 controls the voltage such that it is increased in steps. In this case, in increasing the voltage in steps, as shown in FIG. 2, the increment of the voltage at each step is decreased as the voltage approaches the target voltage. By doing so, it is possible to further surely control the high voltage power circuit such that no rush current flows at the time of starting the electrostatic atomizer.

Further, in the embodiments shown in FIGS. 1 and 2, a voltage (referred to as "starting voltage") during a time period from the time when the target high voltage is obtained by gradually increasing the applied voltage to the time when the electrostatic atomization starts is set higher than the voltage (referred to as "atomization voltage") for stably performing the electrostatic atomization after the starting of the electrostatic atomization.

That is, as shown in FIGS. 1 and 2, when the high voltage is applied to the atomizing electrode 1 at the time of starting the electrostatic atomizer 4, the target high voltage (that is, the starting voltage) is obtained by gradually increasing the voltage as shown in FIG. 1. The starting voltage is set higher than the atomization voltage applied after the starting of the electrostatic atomization (for example, the starting voltage is set higher by about 0.2 kV than the atomization voltage).

After an electrostatic atomization detection unit 5 detects the starting of the electrostatic atomization, the applied voltage is decreased from the starting voltage to the atomization voltage by control of the control unit 5. In the embodiment shown in the control block diagram of FIG. 3, the discharge current detection circuit 6 detects discharge current as discharge starting time at which the water supplied to the tip portion of the atomizing electrode 1 grows in a Taylor cone, and electric charges are concentrated on the leading end of the Taylor cone to be densified, so that the water around the leading end of Taylor cone receives great energy (repulsive force of the densified charges) and is repeatedly segmented and scattered (Rayleigh scattering). Then, the results of the discharge current detected by the discharge current detection circuit 6 are input to the control unit 8 including a microcomputer. The high voltage power circuit 3 is controlled by control signals transmitted from the control unit 8, so that the applied voltage is decreased from the starting voltage to the atomization voltage for stably performing the electrostatic atomization.

The atomization voltage for stably performing the electrostatic atomization varies depending on the kind of product. For example, when the atomization voltage is 4.8 kV, the starting voltage is set at 5 kV, which is higher by 0.2 kV than the atomization voltage. Here, in the present embodiments, as shown in FIG. 3, the voltage detection circuit 7 is provided, and the control unit 8 controls the voltage based on the results detected by the voltage detection circuit 7 such that the voltage becomes the atomization voltage. Therefore, the voltage variation depending on components or atmospheric environments can be restricted in a narrow range, and the high voltage can be controlled with precise.

As described above, in the present embodiments, since the starting voltage is set higher than the atomization voltage, it is possible to reduce the time taken to start the electrostatic atomization, during which the water supplied to the tip portion of the atomizing electrode 1 grows in a Taylor cone, and electric charges are concentrated on the leading end of the Taylor cone to be densified, so that the water around the leading end of Taylor cone receives great energy (repulsive force of the densified charges) and is repeatedly segmented and scattered (Rayleigh scattering).

Here, the time taken to start the electrostatic atomization is reduced by setting the starting voltage higher than the atomization voltage as described above, and it is considered that the electrostatic atomization is performed at the high voltage same as the starting voltage even after the starting of the electrostatic atomization. However, in this case, since the electrostatic atomization is not stably performed, it is not preferable.

Meanwhile, in case the starting voltage is set equal to the atomization voltage for stably performing the electrostatic atomization, as described above, since the time taken to start the electrostatic atomization is excessively increased, it is not preferable.

Figure 4:
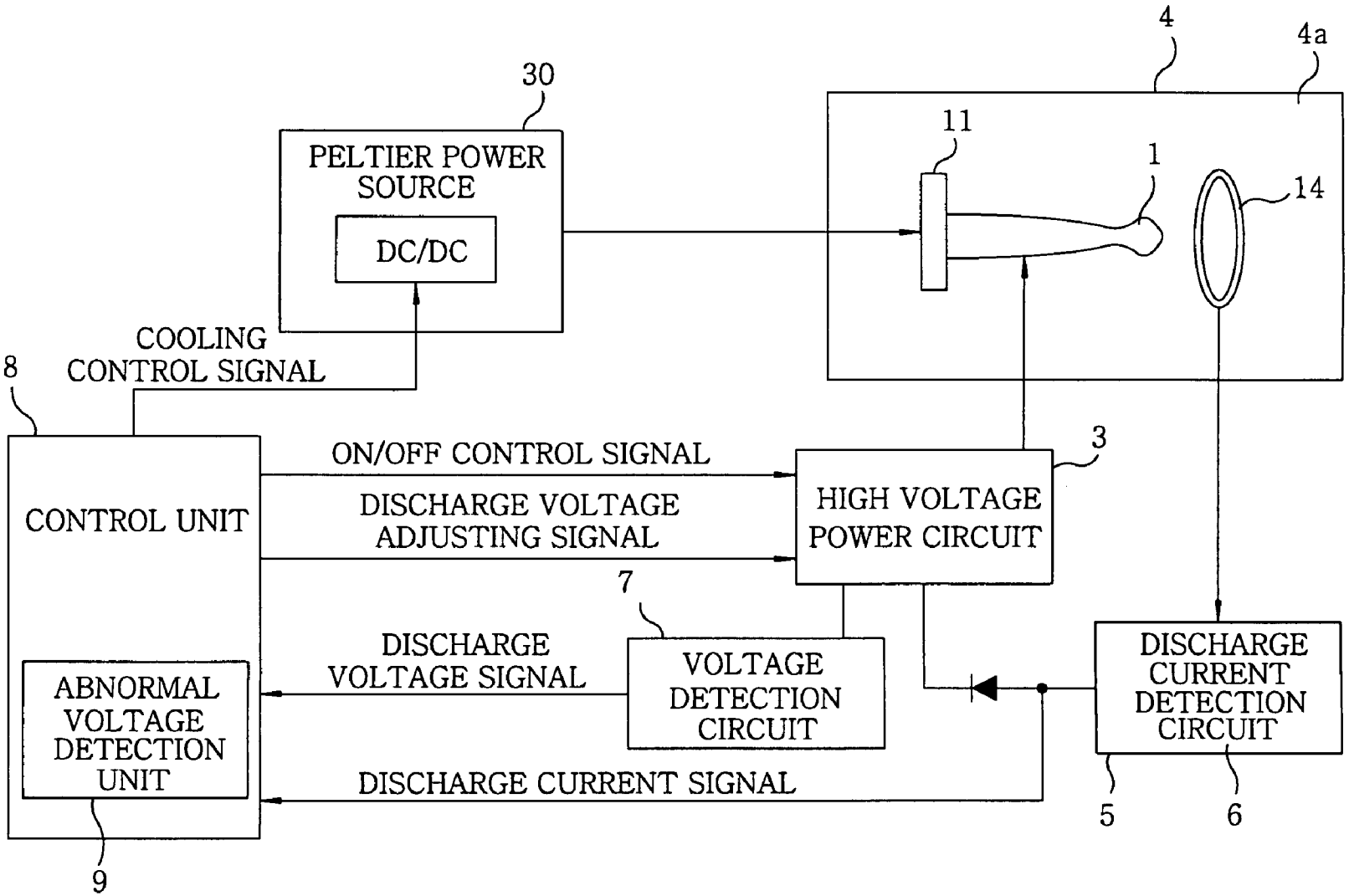
FIG. 4 is a control block diagram in accordance with another embodiment of the present invention.
Figure 5:
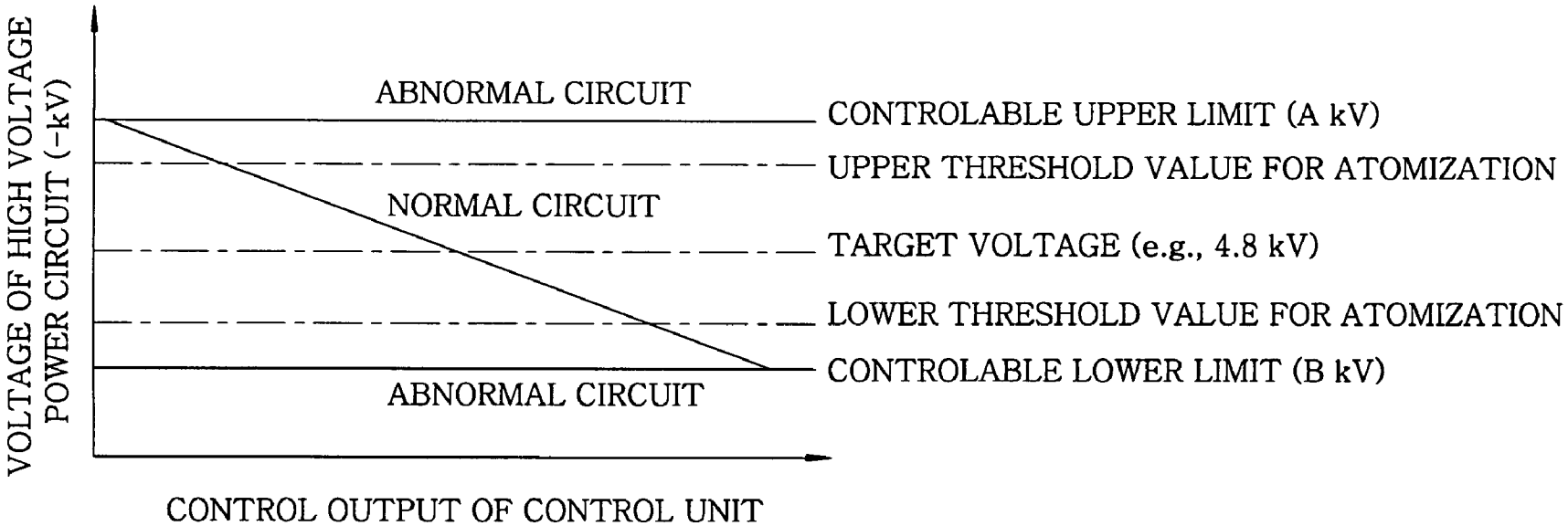
FIG. 5 is a graph showing the relation between the voltage of the high voltage power circuit and the control output of a control unit.

FIG. 4 shows a control block diagram in accordance with still another embodiment of the present invention. In this embodiment, the control unit 8 is provided with an abnormal voltage detection unit 9 for detecting the abnormality in the voltage of the high voltage power circuit 3. In this embodiment, as shown in FIG. 5, with respect to voltage control during the electrostatic atomization, an upper limit A kV and a lower limit B kV of the controllable range of the high voltage for continuously operating the electrostatic atomizer 4 by the control unit 8 are respectively set to exceed an upper and a lower limit (of tolerance of the atomization voltage (target voltage) at which the electrostatic atomization is stably performed. For convenience, in FIG. 4, the upper and the lower limit of the tolerance of the atomization voltage are defined as an upper and a lower threshold value for electrostatic atomization, respectively. The target voltage is set within the upper and the lower threshold value for electrostatic atomization of the high voltage range in which the electrostatic atomization is stably performed.

Even when the voltage exceeds the upper and the lower limit of the voltage range in which the electrostatic atomization is stably performed, if the high voltage falls between the upper and the lower limit of the controllable range of the high voltage for continuously operating the electrostatic atomizer 4 by the control unit 8, the control unit 8 determines that the high voltage power circuit is normal and controls the voltage to be the target voltage of the product at which the electrostatic atomization is stably performed. Meanwhile, only when the voltage exceeds the upper and the lower limit (A kV and B kV) of the controllable range of the high voltage for continuously operating the electrostatic atomizer 4 by the control unit 8, the abnormal voltage detection unit 9 detects the abnormality of the voltage. In this way, when the abnormal voltage detection unit 9 detects the abnormality of the voltage, the control unit 8 determines that the high voltage power circuit 3 is abnormal, and thus the application of voltage by the high voltage power circuit is stopped or the operation of the electrostatic atomizer is stopped.

Therefore, in accordance with the present embodiment, when the voltage falls between the upper and the lower limit of the controllable range of the high voltage for continuously operating the electrostatic atomizer 4 by the control unit 8, even though the voltage exceeds the upper and the lower limit of the voltage range in which the electrostatic atomization is stably performed, the voltage is adjusted to the target voltage by the control unit 8, and thus the electrostatic atomizer can be continuously operated. Meanwhile, when the voltage exceeds the upper and the lower limit of the controllable range of the high voltage for continuously operating the electrostatic atomizer 4 by the control unit 8, the abnormal voltage detection unit 9 detects the abnormality of the voltage, and the control unit 8 determines that the high voltage power circuit 3 is abnormal, and thus the application of voltage by the high voltage power circuit 3 is stopped or the operation of the electrostatic atomizer 4 is made OFF, thereby increasing safety.

Figure 6:
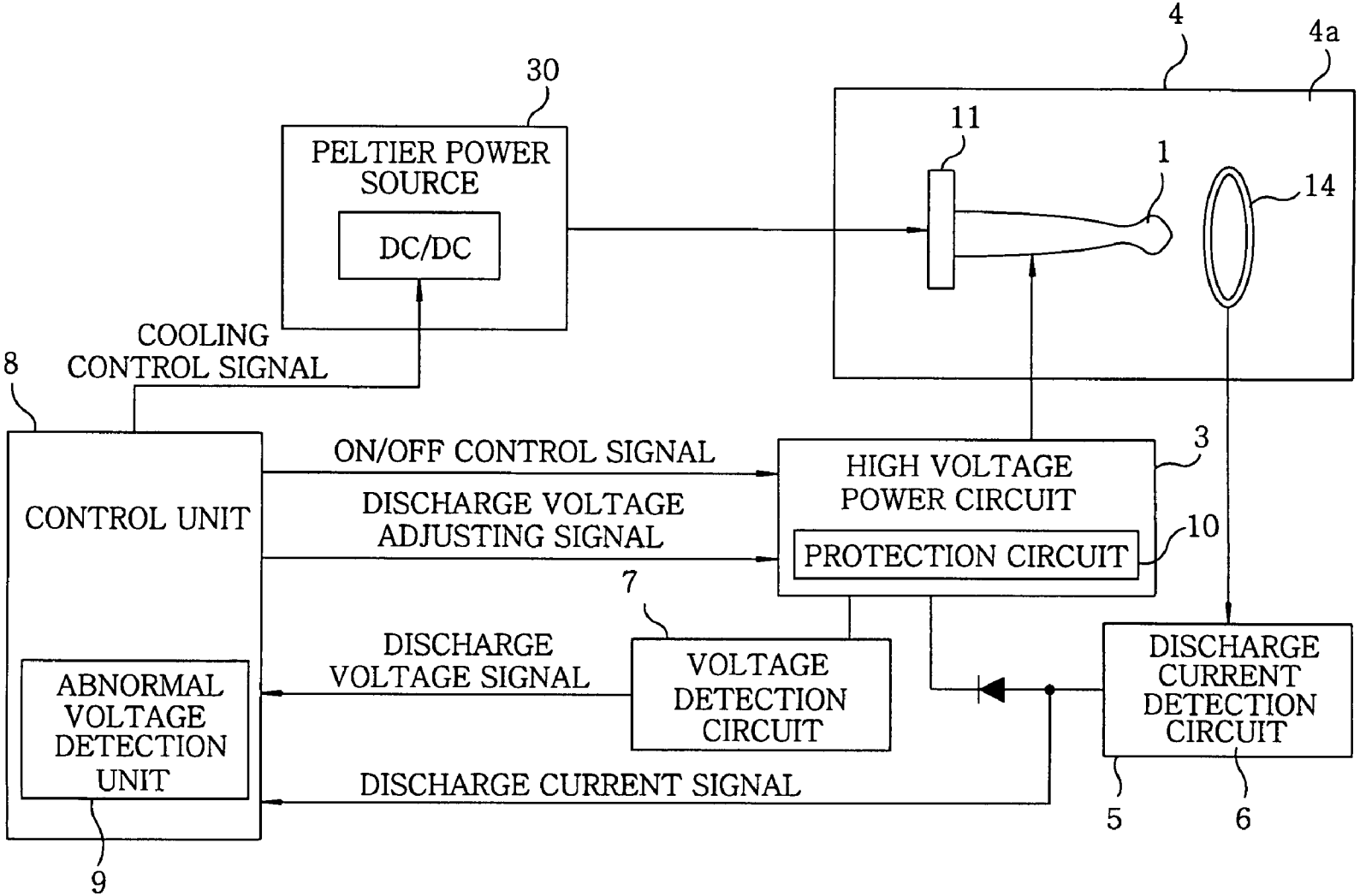
FIG. 6 is a control block diagram in accordance with still another embodiment of the present invention.

FIG. 6 shows a control block diagram in accordance with still another embodiment of the present invention. In this embodiment, a protection circuit 10 is provided to the high voltage power circuit 3 in order to decrease the voltage when a discharge current output in the high voltage power circuit 3 is increased beyond a predetermined value. Therefore, when the control unit 8 is overloaded and thus does not operate, even though the discharge current output is increased higher than the predetermined value, the protection circuit 10 can control the voltage, thus ensuring safety.

Figure 7:
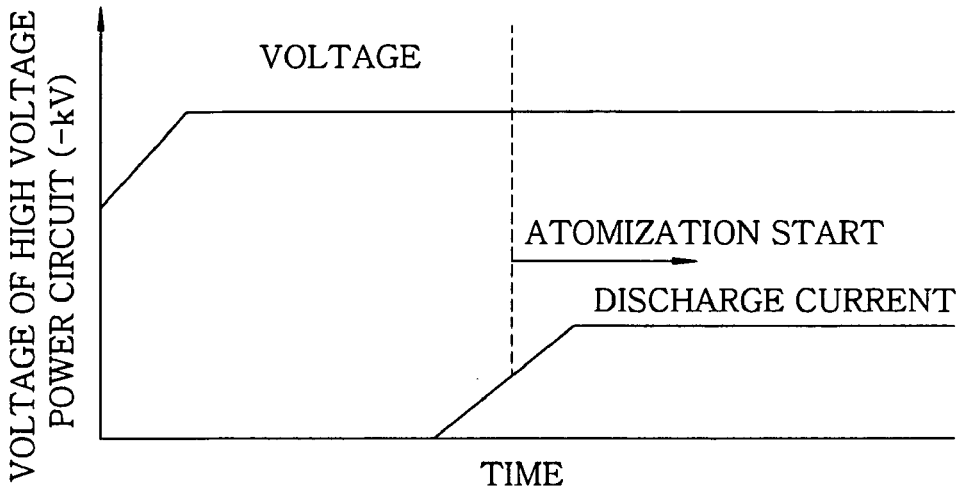
FIG. 7 is a graph showing a time chart of the voltage applied from a high voltage power circuit to an atomizing electrode in accordance with to still another embodiment of the present invention.
Figure 8:
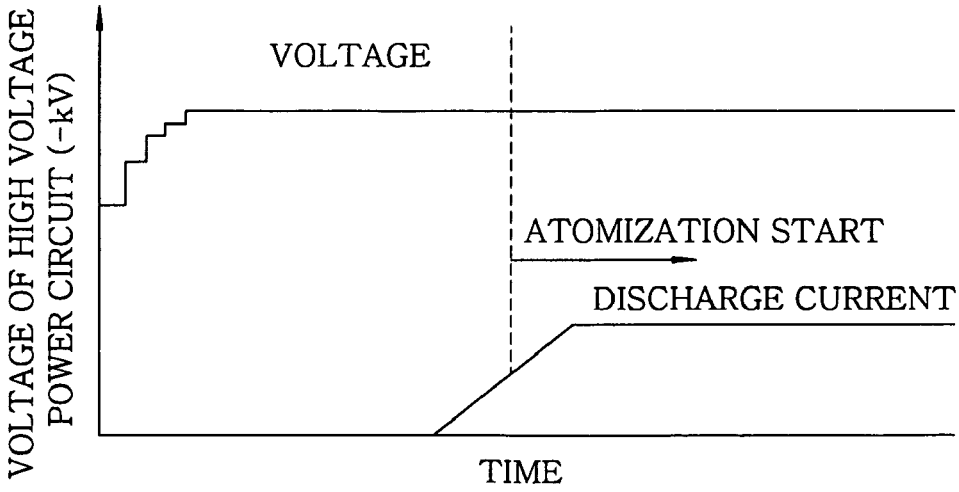
FIG. 8 is a graph showing a time chart of the voltage applied from a high voltage power circuit to an atomizing electrode in accordance with still another embodiment of the present invention.

In the above embodiment, as shown in FIGS. 1 and 2, there have been described the exemplary cases that the voltage (starting voltage) during a time period from the time when the target high voltage is obtained by gradually increasing the applied voltage to the time when the electrostatic atomization starts is set higher than the atomization voltage for stably performing the electrostatic atomization after the starting of the electrostatic atomization. However, as shown in FIGS. 7 and 8, a target high voltage obtained by gradually increasing the voltage applied to the atomizing electrode 1 may be used as the atomization voltage for stably performing the electrostatic atomization.

Even in this embodiment, rush current can be prevented from flowing at the time of starting the electrostatic atomizer, and the deterioration of the atomizing electrode attributable to the evaporation and wear thereof by idle discharge at the time of starting the electrostatic atomizer can be prevented.

Further, in the above embodiments, the water supply unit 2 is exemplified as the cooling unit to supply water to the atomizing electrode 1 by allowing the moisture in air to be condensed. However, in the present invention, water collected in a water tank may be supplied to the tip portion of the atomizing electrode 1 by a water conveying unit using a capillary phenomenon.

While the present invention has been shown and described with respect to the exemplary embodiments, it will be understood by those skilled in the art that the invention is not limited to the foregoing embodiments but various changes and modifications may be made without departing from the scope of the invention.

What is claimed is:

1. An electrostatic atomizer, comprising:

an atomizing electrode;

a water supply unit for supplying water to the atomizing electrode; and a high voltage power circuit for applying a high voltage to the atomizing electrode to start electrostatic atomization in which the water supplied to the atomizing electrode is atomized to generate electrically charged water particles; and a control unit configured to control the high voltage power circuit such that the voltage applied to the atomizing electrode is gradually increased to a target voltage before the electrostatic atomization starts.

2. The electrostatic atomizer according to claim 1, wherein the control unit controls the high voltage power circuit such that the voltage is increased to a target voltage in steps, and an increment of the voltage at each step is decreased as the voltage approaches the target voltage.

3. The electrostatic atomizer according to claim 1, further comprising an abnormal voltage detection unit for detecting an abnormality in the voltage of the high voltage power circuit, wherein when the voltage exceeds an upper and a lower limit of a controllable range of the voltage for continuously operating the electrostatic atomizer by the control unit, the abnormal voltage detection unit detects the abnormality of the voltage.

4. The electrostatic atomizer according to claim 1, further comprising a protection circuit provided to the high voltage power circuit, the protection circuit serving to decrease the voltage when a discharge current output in the high voltage power circuit is increased beyond a predetermined value.

5. The electrostatic atomizer according to claim 2, further comprising an abnormal voltage detection unit for detecting an abnormality in the voltage of the high voltage power circuit, wherein when the voltage exceeds an upper and a lower limit of a controllable range of the voltage for continuously operating the electrostatic atomizer by the control unit, the abnormal voltage detection unit detects the abnormality of the voltage.

6. The electrostatic atomizer according to claim 2, further comprising a protection circuit provided to the high voltage power circuit, the protection circuit serving to decrease the voltage when a discharge current output in the high voltage power circuit is increased beyond a predetermined value.

7. The electrostatic atomizer according to claim 3, further comprising a protection circuit provided to the high voltage power circuit, the protection circuit serving to decrease the voltage when a discharge current output in the high voltage power circuit is increased beyond a predetermined value.

8. The electrostatic atomizer according to claim 5, further comprising a protection circuit provided to the high voltage power circuit, the protection circuit serving to decrease the voltage when a discharge current output in the high voltage power circuit is increased beyond a predetermined value.

9. The electrostatic atomizer according to claim 3, wherein when the abnormal voltage detection unit detects the abnormality of the voltage, the control unit stops the application of voltage performed by the high voltage power circuit or the operation of the electrostatic atomizer.

10. The electrostatic atomizer according to claim 1, wherein the voltage applied to the atomizing electrode is gradually increased to the target voltage such that rush current is prevented from flowing in the atomizing electrode.

11. The electrostatic atomizer according to claim 1, wherein the target voltage is set greater than the voltage applied to the atomizing electrode after the electrostatic atomization starts.

* * * * *